US012029360B2

(12) United States Patent
Milcheck

(10) Patent No.: US 12,029,360 B2
(45) Date of Patent: Jul. 9, 2024

(54) SHOWER AND BATH SCRUBBING ACCESSORY FOR USE WITH A DISPOSABLE SCRUBBER, AND ASSOCIATED METHODS

(71) Applicant: Kevin James Milcheck, Mount Dora, FL (US)

(72) Inventor: Kevin James Milcheck, Mount Dora, FL (US)

(73) Assignee: Kevin James Milcheck, Mount Dora, FL (US)

( * ) Notice: Subject to any disclaimer, the term of this patent is extended or adjusted under 35 U.S.C. 154(b) by 0 days.

(21) Appl. No.: 18/305,334

(22) Filed: Apr. 22, 2023

(65) Prior Publication Data

US 2024/0164595 A1 May 23, 2024

Related U.S. Application Data

(60) Provisional application No. 63/475,597, filed on Nov. 18, 2022.

(51) Int. Cl.
*A47K 7/02* (2006.01)

(52) U.S. Cl.
CPC ..... *A47K 7/028* (2013.01)

(58) Field of Classification Search
CPC . A47K 7/028; A47K 7/08; A47K 7/06; A46B 9/005; A46B 5/0095; A46B 2200/1006
See application file for complete search history.

(56) References Cited

U.S. PATENT DOCUMENTS

| | | | | |
|---|---|---|---|---|
| 6,276,022 | B1 * | 8/2001 | Gallacher | A47K 7/028 15/147.2 |
| 10,398,262 | B1 * | 9/2019 | Pheatt | A47K 7/028 |
| 10,786,123 | B1 * | 9/2020 | Chang | A47K 7/028 |
| 11,419,461 | B1 * | 8/2022 | Papageorge | A47K 7/028 |
| 2023/0233035 | A1 * | 7/2023 | Lopez | A46B 9/005 15/145 |

* cited by examiner

*Primary Examiner* — Shay Karls

(57) ABSTRACT

The shower and bath scrubbing accessory that can be used with a disposable scrubber having an attached string. The accessory includes an elongated body with a handle portion and a head portion. The head portion has a scrubber holder and a string channel adjacent to it, which guides the string from one side of the head portion to the opposite side. Additionally, there is a string securing feature on the elongated body, which holds the scrubber tightly at the scrubber holder. The elongated body may be a single piece or a multi-piece elongated body. The scrubber holder may be a cup defined by a raised wall or raised protrusions on the first side of the head portion, and the string channel may be positioned within the cup. The string securing feature may be positioned on the handle or head portion of the elongated body, and it may include a plurality of string holders positioned at various distances from the string channel.

18 Claims, 4 Drawing Sheets

SHOWER AND BATH SCRUBBING ACCESSORY FOR USE WITH A DISPOSABLE SCRUBBER, AND ASSOCIATED METHODS

RELATED APPLICATIONS

This application claims priority to U.S. Provisional Application Ser. No. 63/475,597 filed Nov. 18, 2022 titled "The Puffy Stick Washing Tool" which is incorporated herein in its entirety by reference.

FIELD

The present invention relates in general to the field of bath and shower accessories, and particularly to an accessory for securely attaching a disposable scrubber.

BACKGROUND

Shower scrubbers are used to exfoliate and clean the skin during bath or shower time. They come in different shapes, sizes, and materials, and can be disposable or reusable. Scrubbers can be used with or without soap, and they help to remove dirt, oil, dead skin cells, and other impurities from the skin.

The use of scrubbers dates back to ancient times, where people used natural materials such as loofahs, sisal, and natural bristle brushes to cleanse and exfoliate their skin. In recent times, the use of synthetic materials such as nylon, polyester, and polyurethane foam has become more popular due to their affordability, durability, and availability.

Disposable scrubbers are becoming increasingly popular, as they offer convenience and hygiene benefits. These scrubbers, such as shower puffs, come pre-packaged and can be used for a limited time before being disposed of. They are typically made of synthetic materials and can be infused with various cleansing agents or fragrances.

Reusable scrubbers, on the other hand, can be used multiple times and are more environmentally friendly than disposable scrubbers. They can be made of natural or synthetic materials and can come in different shapes and sizes, such as puffs, mitts, gloves, or brushes. Reusable scrubbers require regular cleaning and disinfection to maintain their hygiene.

Shower scrubbers can have different levels of abrasiveness, depending on their material and design. While some scrubbers are gentle enough for daily use, others may be too harsh for sensitive skin or frequent use. Users should choose a scrubber that suits their skin type and sensitivity level.

In addition to manual scrubbers, there are also electric scrubbers available on the market. These scrubbers use battery-powered motors to rotate or vibrate the scrubber head, providing a deeper and more efficient cleanse. Electric scrubbers can be more expensive than manual scrubbers and may require more maintenance, such as battery replacement or charging.

Shower scrubbers are not only used for personal hygiene but can also have therapeutic benefits. Regular exfoliation with a scrubber can improve blood circulation, unclog pores, and promote cell renewal. Additionally, using a scrubber can help to prevent ingrown hairs, reduce the appearance of cellulite, and prepare the skin for hair removal.

Thus, shower scrubbers are an essential tool for maintaining good personal hygiene and promoting skin health. They come in different types and designs to suit individual preferences and skin types. While disposable scrubbers offer convenience and hygiene benefits, reusable scrubbers are more eco-friendly and cost-effective.

Additionally, washing hard to reach places such as the back and legs presents a challenge. There is a need for a shower accessory that can securely hold a disposable shower scrubber such as a shower puff, etc. and is configured to more easily reach the back and legs, for example.

This background information is provided to reveal information believed by the applicant to be of possible relevance to the present invention. No admission is necessarily intended, nor should be construed, that any of the preceding information constitutes prior art against the present invention.

SUMMARY OF THE EMBODIMENTS

The present invention is a shower and bath scrubbing accessory that can be used with a disposable scrubber having an attached string. The accessory includes an elongated body with a handle portion and a head portion. The head portion has a scrubber holder and a string channel adjacent to it, which guides the string from one side of the head portion to the opposite side. Additionally, there is a string securing feature on the elongated body, which holds the scrubber tightly at the scrubber holder.

The elongated body may be a single piece or a multi-piece elongated body. The scrubber holder may be a cup defined by a raised wall or raised protrusions on the first side of the head portion, and the string channel may be positioned within the cup. The string securing feature may be positioned on the handle or head portion of the elongated body, and it may include a plurality of string holders positioned at various distances from the string channel.

The string channel may be a slot extending from the edge of the head portion towards its central area, and it may narrow in the direction from the edge to the central portion. Alternatively, the string channel may be a through-hole in the head portion.

The invention also includes a method of making the shower and bath scrubbing accessory. The method involves forming an elongated body with a handle and head portion. The head portion is formed to include a scrubber holder and a string channel adjacent to it, which guides the string from one side to the opposite side. A string securing feature is positioned on the elongated body to secure the scrubber tightly at the scrubber holder.

Overall, the invention provides a convenient and efficient accessory for using disposable scrubbers during shower or bath time, with a simple yet effective design that is easy to manufacture.

BRIEF DESCRIPTION OF THE DRAWINGS

The example embodiments are best understood from the following detailed description when read with the accompanying drawing figures. In fact, the dimensions may be arbitrarily increased or decreased for clarity of discussion. Wherever applicable and practical, like reference numerals refer to like elements.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

FIGS. 1-6 illustrate an example embodiment of a shower and bath scrubbing accessory 10 for use with a disposable scrubber 40 in accordance with features of the present invention. The disposable scrubber 40 has an attached string 42 as is known to those skilled in the art. A disposable scrubber 40 may include any handheld type of shower puff, sponge, loofah or similar item that includes a string, cord, rope or other type of line. Such disposable scrubbers 40, such as shower puffs, come pre-packaged and can be used for a limited time before being disposed. They are typically made of synthetic materials. The following description may refer to shower puffs as an example of a disposable scrubber 40.

Figure 1:
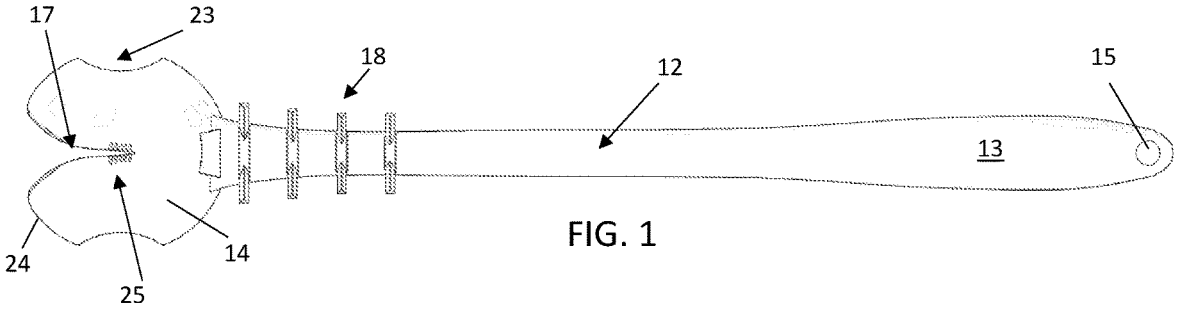
FIG. 1 is a back view illustrating an example embodiment of a shower and bath scrubbing accessory for use with a disposable scrubber in accordance with features of the present invention.
Figure 2:
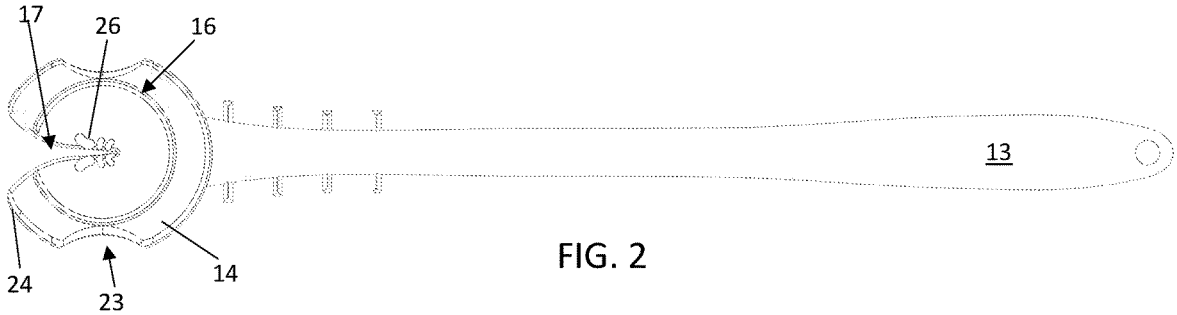
FIG. 2 is a front view illustrating the shower and bath scrubbing accessory of FIG. 1.
Figure 3:
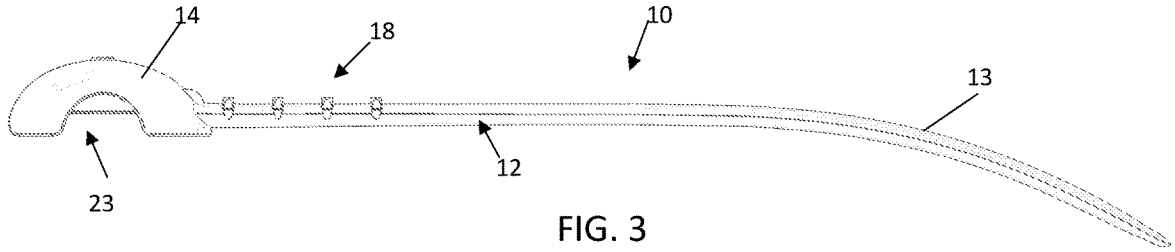
FIG. 3 is a side view illustrating the shower and bath scrubbing accessory of FIG. 1.

The accessory 10 includes an elongated body 12 with a handle portion 13 and a head portion 14. The elongated body 12 may be a single piece or a multi-piece elongated body. The elongated body 12 may be made of plastic, for example. Other materials are contemplated. The handle portion 13 is shown in FIG. 3 to have a slight bend to help a user reach the back area when washing, but it can also be straight. Also, the bend can be at any portion of the elongated body and at various degrees depending on the desired reach. The handle portion 13 is shown to have a hole 15 at the end to easily hang on a wall hook. The head portion 14 is shown as round or circular but could include other shapes as well. The head portion 14 may include cutouts 23 to aid in stabilizing the disposable scrubber 40 when attached to the head portion 14. There are two cutouts 23 shown but there could be more, and they could vary in size depending on the desired stability.

The head portion 14 has a scrubber holder 16 and a string channel 17 adjacent to it, which guides the string 42 from a front side of the head portion 14 to the opposite side. The scrubber holder 16 may, for example, be a cup 20 defined by a raised wall 22 or raised protrusions on the front side of the head portion 14. The cup 20 is shown as circle but could be formed in other shapes as well. The scrubber holder 16 could also be a raised portion to provide friction. The string channel 17 may be positioned within the cup 20. The string channel 17 may be a slot extending from the edge 24 of the head portion 14 towards its central area 25, and it may narrow in the direction from the edge 24 to the central portion 25. Alternatively, the string channel 17 may be a through-hole in the head portion 14.

Figure 5:
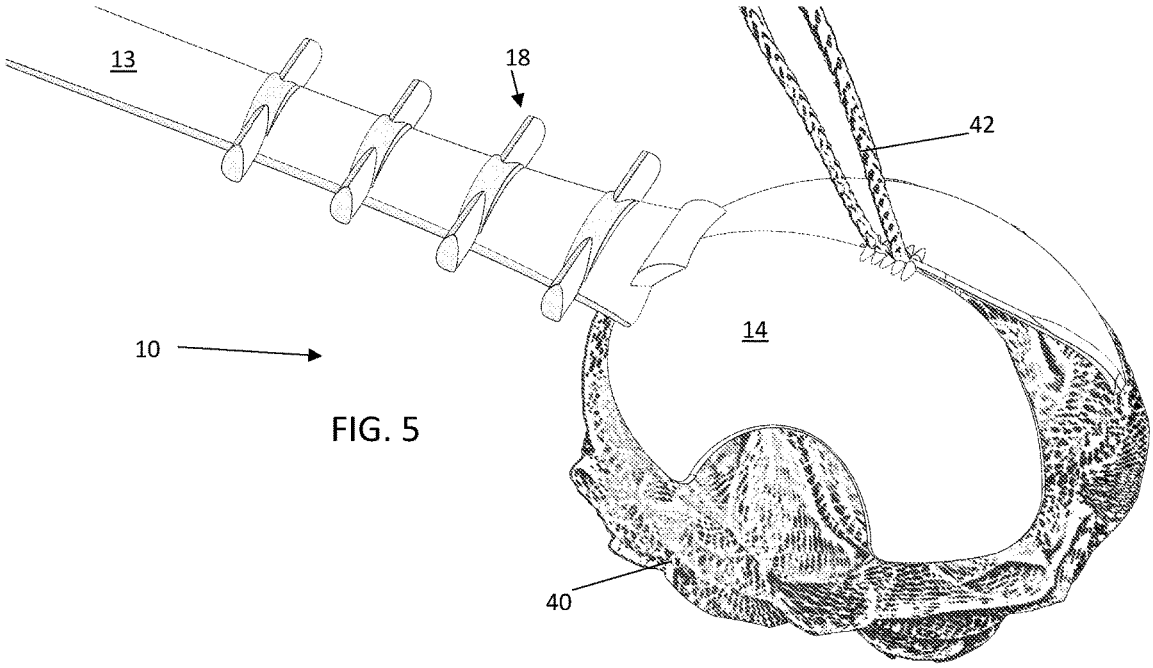
FIG. 5 is another back perspective view illustrating details of the shower and bath scrubbing accessory of FIG. 1 with the disposable scrubber being attached.

FIG. 5 shows the string channel 17 as a slot where the string 42 of the shower puff is pulled through where the opening distance is larger at the top to easily pull through with decreasing distance all the way or up to a point and then the same distance to allow a user to tightly pull the disposable scrubber 40 in place and to firmly position within the head portion 14. The scrubber holder 16 stabilizes the secured disposable scrubber 40 when the string 42 is pulled tight through the string channel 17.

Figure 7:
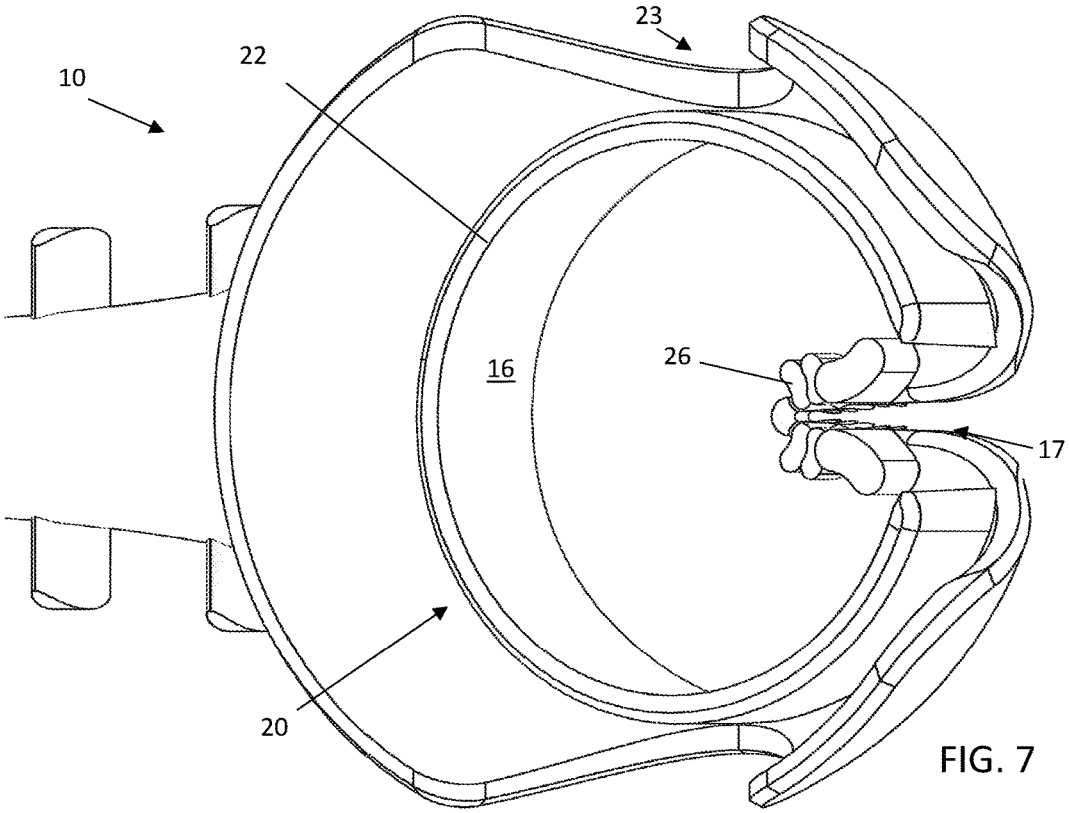
FIG. 7 is a front perspective view illustrating details of the shower and bath scrubbing accessory of FIG. 1.

String channel 17 as illustrated may be completely straight, or a slight bevel can be added to form a smaller pinching point, or may include added protrusions 26 (FIG. 7), bulges and indents varying in size, design and distance located on side faces, upper and lower faces or both of string channel 17 to provide friction and prevent the string 42 from dislodging or sliding from string channel 17. String channel 17 does not necessarily have to be positioned in the front of head portion 14 as shown in the drawings, but can be positioned on the side at any degree. The string channel 17 does not have to be straight as shown and can incorporate a half circle, half oval or a V design, for example, and thus provide an anti-slip to the normal direction of scrubbing which may be in the direction of handle portion 13.

Additionally, there may be a string securing feature 18 on the elongated body 12, which holds the scrubber 40 tightly at the scrubber holder 16. The string securing feature 18 may be positioned on the handle portion 13 or even the head portion 14 of the elongated body 12. The string securing feature 18 is illustrated as a plurality of string holders 19 positioned at various distances away from the string channel 17. The number of string holders 19 may vary. Although the string holders 19 are shown as protuberances, the structure of the string holders 19 may vary, as they could be notches, grooves, cleats or any other structure that enables the user to secure the string 42 thereto. The string holders 19 are configured to secure the string 42 of the disposable scrubber 40 after the string 42 is pulled tightly through the string channel 17.

Figure 6:
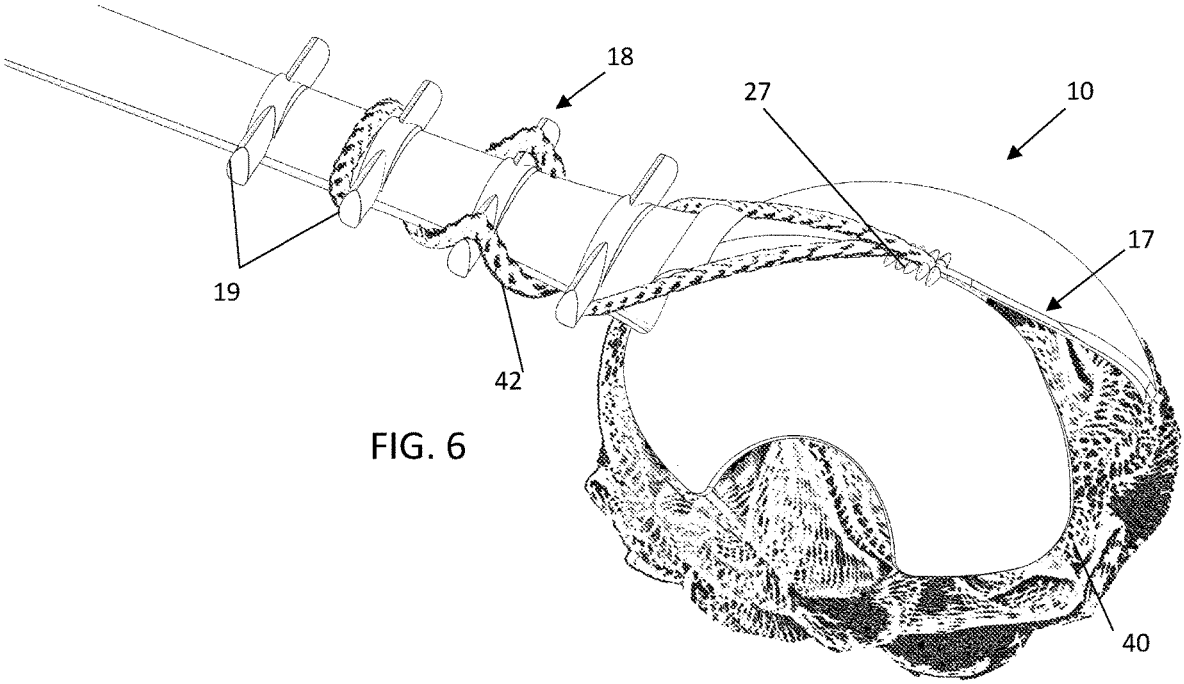
FIG. 6 is another back perspective view illustrating details of the shower and bath scrubbing accessory of FIG. 1 with the disposable scrubber securely attached.

As shown in FIG. 6, the string 42 is wrapped around the string holders 19 in an example configuration. Of course, there are many different ways a user could wrap and/or tie the string 42 around the string holders 19 in order to tightly secure the string 42 thereon, and thereby tightly secure the disposable scrubber 40 within the head portion 14 and scrubber holder 16 for use in the shower or bath.

Figure 4:
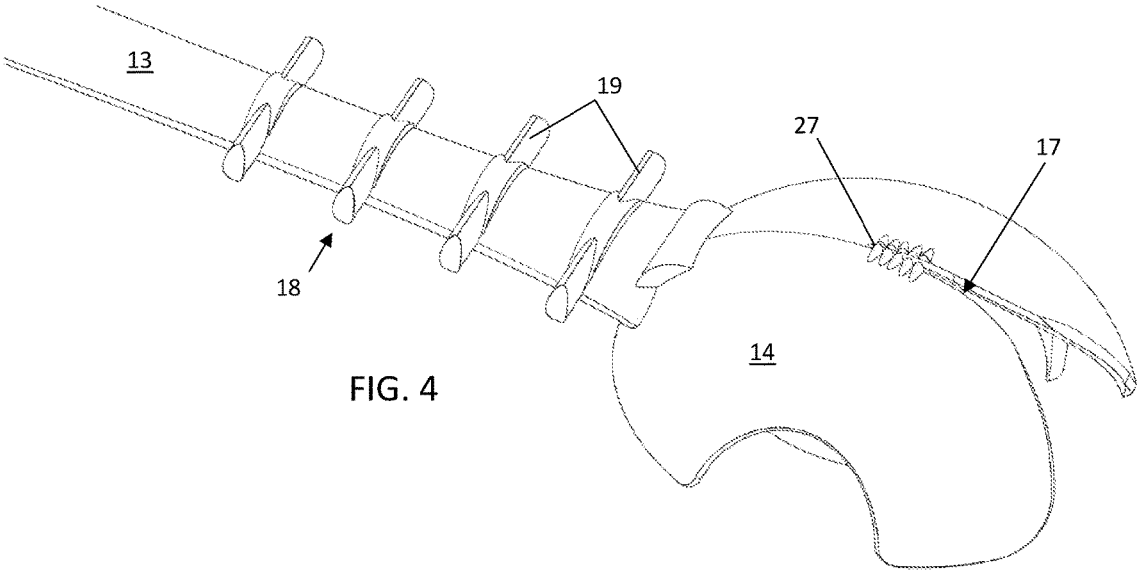
FIG. 4 is a back perspective view illustrating details of the shower and bath scrubbing accessory of FIG. 1 without a disposable scrubber attached.

FIGS. 1 and 3-6 & 8 illustrate a plurality of bumps or bulges 27 on the back of the head portion 14 and the side of string channel 17, at the proximal end of the string channel 17. These bulges 27 secure or may aid in securing the string 42 once it has been pulled tightly through the string channel 17 as shown in FIG. 4, for example. These bulges 27 may vary in number, size, design, and distance to provide the desired friction fit for the string 42. For example, there may be one continuous bulge that wraps around the end of the string channel 17 or even one bulge on each side of the string channel 17. The bulges 27 can be designed using a plurality of geometries from round, oval, square, triangular, etc. and may include a multitude of geometries, angles, and combinations thereof. The bulges 27 may include indents of any geometry, and may be located on the side face, upper and lower faces or both of the string channel 17 as shown in FIGS. 1, 3-6 & 8 or even on the front side of the head portion 14. As an example, such indents may be spherical cutouts along the string channel 17 (on the front or back side of the head portion 14) and create a narrowing pinching point by protruding into the string channel 17. Other geometries are contemplated as long as they perform the function of aiding in securing the string 42 once it has been pulled tightly through the string channel 17.

Figure 8:
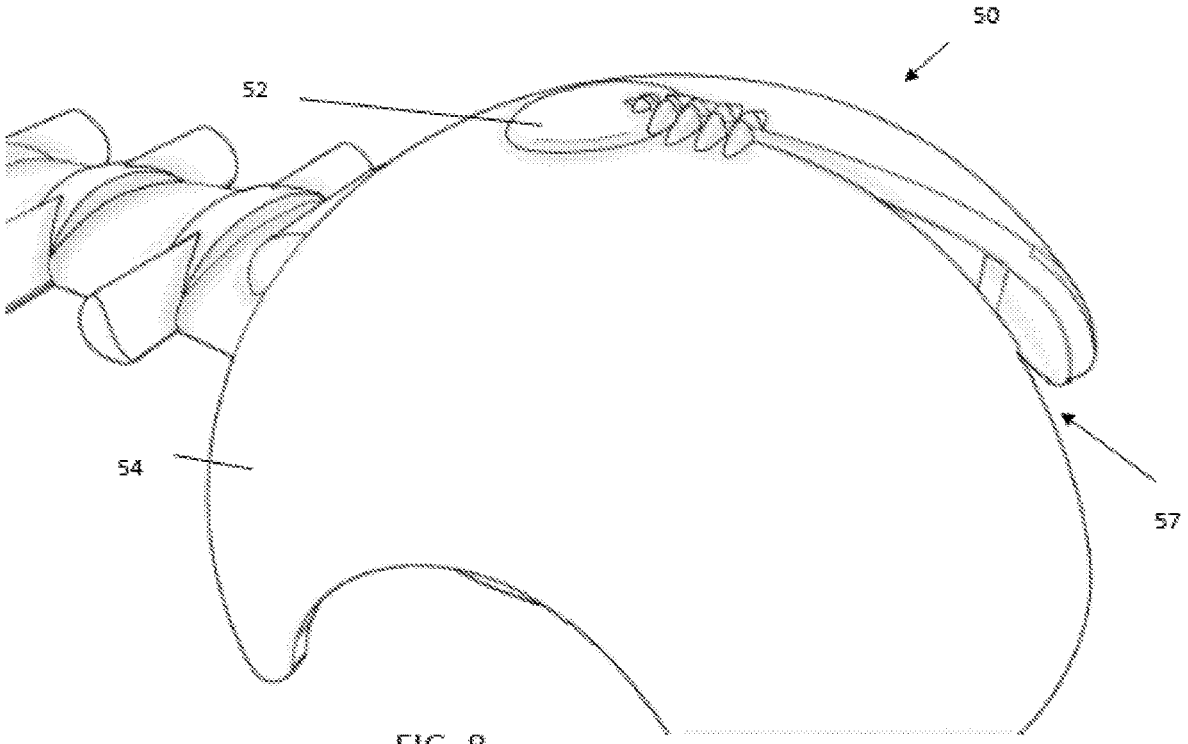
FIG. 8 is a back view of a portion of another embodiment of a shower and bath scrubbing accessory in accordance with features of the present invention.

FIG. 8 shows another embodiment of the shower and bath scrubbing accessory 50 and includes a round raised section 52 on the back of the head portion 54 adjacent the proximal end of the string channel 57. The raised round section 52 adds strength to the head portion 54 and also aids in removal of the string 42 from the string channel 57 when it is time to replace the disposable scrubber 40. The raised section 52 can be any shape, size or design as long as it aids in the removal of the string 42.

The invention also includes a method of making the shower and bath scrubbing accessory 10. The method involves forming an elongated body 12 with a handle portion 13 and head portion 14. The head portion 14 is formed to include a scrubber holder 16 and a string channel 17 adjacent to it, which guides the string 42 of a disposable scrubber 40 from one side to the opposite side of the head portion 14. A string securing feature 18 is positioned on the elongated body 12 to secure the scrubber 40 tightly at the scrubber holder 16.

Overall, the invention provides a convenient and efficient accessory for using disposable scrubbers 40 during shower or bath time, with a simple yet effective design that is easy to manufacture.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

The above description provides specific details, such as material types and processing conditions to provide a thorough description of example embodiments. However, a person of ordinary skill in the art would understand that the embodiments may be practiced without using these specific details.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Thus, the scope of the invention should be determined by the appended claims and their legal equivalents, and not by the examples given.

The invention claimed is:

1. A shower and bath scrubbing accessory for use with a disposable scrubber having an attached string, the accessory comprising:

an elongated body extending from a bottom end, defining a handle portion, to a top end, defining a head portion, the head portion comprising an upper and lower face, the lower face includes a scrubber holder, a V-shaped string channel with side faces, extends between the upper and lower face of the head portion and is configured to guide the string from a first side of the head portion to a second side, opposite the first side, of the head portion;

further comprising at least one of bulges, protrusions and indents positioned on the side faces of the V-shaped string channel and/or the upper and/or lower faces adjacent to the side faces of the V-shaped string channel, to provide a friction fit for the string by creating a pinching point for the string.

2. The shower and bath scrubbing accessory according to claim 1, wherein the elongated body is at least one of a single piece elongated body or a multi-piece elongated body.

3. The shower and bath scrubbing accessory according to claim 1, wherein the scrubber holder comprises a cup defined by at least one raised wall on the first side of the head portion.

4. The shower and bath scrubbing accessory according to claim 3, wherein the string channel is positioned within the cup.

5. The shower and bath scrubbing accessory according to claim 1, further comprising a raised section adjacent a proximal end of the string channel and configured to aid a user while removing the string from the string channel.

6. The shower and bath scrubbing accessory according to claim 1, wherein the scrubber holder comprises a cup defined by raised protrusions on the first side of the head portion.

7. The shower and bath scrubbing accessory according to claim 1, wherein the string channel comprises a slot extending from the first side of the head portion towards a central area thereof.

8. The shower and bath scrubbing accessory according to claim 7, wherein the slot narrows in a direction from the first side of the head portion towards the central portion thereof.

9. The shower and bath scrubbing accessory according to claim 1, wherein the string channel comprises a though-hole in the head portion.

10. The shower and bath scrubbing accessory according to claim 1, wherein a string securing feature is positioned on the elongated body and configured to secure the excess string so that the string is firmly attached.

11. The shower and bath scrubbing accessory according to claim 10, wherein the string securing feature is positioned on the handle portion of the elongated body.

12. The shower and bath scrubbing accessory according to claim 10, wherein the string securing feature is positioned on the head portion of the elongated body.

13. The shower and bath scrubbing accessory according to claim 10, wherein the string securing feature comprises a plurality of string holders positioned on the elongated body at various distances away from the string channel.

14. A method of making a shower and bath scrubbing accessory for use with a disposable scrubber having an attached string, the method comprising:

forming an elongated body extending from a bottom end, defining a handle portion, to a top end, defining a head portion, forming the head portion to comprise an upper and lower face, wherein;

the lower face includes a scrubber holder, and a V-shaped string channel with side faces, extending between the upper and lower face of the head portion and is configured to guide the string from a first side of the head portion to a second side, opposite the first side, of the head portion;

further positioning at least one of bulges, protrusions and indents positioned on the side faces of the V-shaped string channel and/or the upper and/or lower faces adjacent to the side faces of the V-shaped string channel, to provide a friction fit for the string by creating a pinching point for the string.

15. The method according to claim 14, wherein the elongated body is a single piece elongated body.

16. The method according to claim 14, wherein the elongated body is a multi-piece elongated body.

17. The method according to claim 14, wherein the scrubber holder comprises a cup defined by a raised wall on the first side of the head portion.

18. The method according to claim 14, wherein the string channel comprises a slot extending from the first side of the head portion towards a central area thereof.

* * * * *